US007944777B2

(12) United States Patent
Godat et al.

(10) Patent No.: US 7,944,777 B2
(45) Date of Patent: May 17, 2011

(54) WATCH FITTED WITH AN ELECTRIC MOTOR CONTROL CASE

(75) Inventors: Yves Godat, Cornaux (CH); Fabien Blondeau, Chézard St-Martin (CH); Yves Sierro, Diesse (CH); Nicolas Jeannet, Chambrelien (CH)

(73) Assignee: EM Microelectronic-Marin SA, Marin (CH)

( * ) Notice: Subject to any disclaimer, the term of this patent is extended or adjusted under 35 U.S.C. 154(b) by 120 days.

(21) Appl. No.: 12/486,335

(22) Filed: Jun. 17, 2009

(65) Prior Publication Data

US 2010/0002547 A1 Jan. 7, 2010

(30) Foreign Application Priority Data

Jul. 1, 2008 (EP) ..... 08159383

(51) Int. Cl.
*G04B 19/04* (2006.01)

(52) U.S. Cl. ..... 368/80; 368/202

(58) Field of Classification Search ..... 368/76–81, 368/85–87, 155–156, 200–202
See application file for complete search history.

(56) References Cited

U.S. PATENT DOCUMENTS 4,298,971 A * 11/1981 Morokawa et al. ..... 368/204
4,375,049 A * 2/1983 Grand Chavin ..... 318/696
4,387,433 A * 6/1983 Cardenia et al. ..... 250/492.2
4,534,012 A * 8/1985 Yokozawa ..... 368/327
4,757,483 A * 7/1988 Nagahori et al. ..... 368/80
5,056,148 A 10/1991 Hayashi
5,835,457 A * 11/1998 Nakajima ..... 368/204
6,088,300 A * 7/2000 Nakajima et al. ..... 368/28
6,091,221 A * 7/2000 Higuchi ..... 318/685

FOREIGN PATENT DOCUMENTS

EP 1 030 331 A1 8/2000
EP 1 890 204 A1 2/2008
JP 03-222215 A 10/1991

* cited by examiner

*Primary Examiner* — Sean Kayes

(74) *Attorney, Agent, or Firm* — Sughrue Mion, PLLC

(57) ABSTRACT

The invention concerns an electronic watch (8) including:

a motor (5), a power circuit (7) supplying first and second voltage levels;

a case (11), in which there are mounted:

first and second (A, D) output connections;

a switch (9) actuated by an external actuator to connect the first connection to the second level (Vdd);

a control circuit (4) for the motor including first and second three-state gates (12, 14) respectively connected to the first and second connections (A, D), a member (13) selectively connecting the first connection to the first level, the circuit including a test mode wherein the gates are brought to high impedance, the first connection (D) is connected to the first level (Vss), actuation of the actuator is determined as a function of the voltage measured at the output of the first gate.

10 Claims, 2 Drawing Sheets

WATCH FITTED WITH AN ELECTRIC MOTOR CONTROL CASE

This application claims priority from European Patent Application No. 08159383.2 filed Jan. 7, 2008, the entire disclosure of which is incorporated herein by reference.

The invention concerns electronic watches fitted with an electric motor for driving their analogue display means. The invention concerns, in particular, a watch fitted with a control case for the electric motor and a switch that blocks the motor control when an external control member is actuated.

EP Patent Application No. 1 890 204 discloses an electronic watch including an electric motor that drives time display hands, in accordance with data provided by a time base to a motor control device. This watch has a case in which the same integrated circuit includes the electric motor control device and an oscillator. The oscillator and a resonator placed in the case form the time base. The integrated circuit also includes a frequency divider for obtaining the desired working frequency to indicate the exact time. The output of the frequency divider is connected to the control circuit. The control circuit controls the electric motor, which drives the gear trains that rotate the hands. The electric motor is a stepping motor formed of a magnetised rotor, a stator with high magnetic permeability to form the closing of the magnetic circuit and a coil that generates a magnetic field in the stator when it is switched on, so as to convert the stator into a magnet, whose polarity depends upon the direction of the current in the coil. The motor is controlled by a series of positive and negative pulses spaced by power interruptions or cuts. The case has only four external electrical connections, which simplifies the electric wiring. Two of the terminals are used for powering the integrated circuit, whereas the other two terminals are used as control terminals for the motor. One of the two motor control terminals is connected to a switch that is actuated by an external control member of the watch. Actuating this switch blocks the motor control device and interrupts the time indication. This interruption is necessary to allow the time of the watch to be set. In order to differentiate temporally a motor command from a time setting interruption, a resistor is connected between a reference potential and a switch terminal that is connected to the potential.

This type of watch has drawbacks. A time-setting control device generates non-negligible electric power consumption.

It is an object of the invention to overcome one or more of these drawbacks. The invention thus concerns an electronic watch including:

- an electric motor driving analogue display means;
- an electric power source supplying first and second distinct voltage levels;
- a case in which are mounted:
  - first and second output connections;
  - a control circuit for the electric motor that controls the driving of the motor by the selective application of first and second voltage levels to the first and second output connections;
  - an external control actuator;
  - a switch actuated by the external control actuator for selectively connecting the first output connection to the second voltage level;

wherein:

- the electric motor control circuit includes first and second three-state gates, these gates being respectively connected to the first and second output connections, with a member selectively connecting the first output connection to the first voltage level;

- the electric motor control circuit includes a test mode wherein the first and second gates are brought to high impedance, the first output connection is connected to the first voltage level by said member, the output voltage of the first gate is measured, actuation of the external control actuator is determined as a function of the measured output voltage.

According to a variant, the first voltage level is lower than the second voltage level.

According to another variant, the member selectively connecting the first output connection to the first voltage level is a low level return transistor.

According to another variant, the case includes a time base comprising an oscillator and a resonator, first and second input connections respectively receiving the first and second supply voltage levels, and wherein the oscillator and the control circuit are arranged in the same integrated circuit.

According to yet another variant, the control circuit blocks the driving of the electric motor when actuation of the external control actuator is determined.

According to a variant, the control circuit passes into test mode prior to each motor drive command.

According to another variant, the control circuit passes into test mode at least twice before each motor drive command, the control circuit blocking the electric motor drive only when the two passages into test mode have determined actuation of the external control actuator.

According to yet another variant, the case has only four external electric connections.

According to yet another variant, at the end of the test mode, the control circuit applies the voltages applied prior to test mode to the output connections.

According to one variant, the electric motor is a stepping motor.

Other features and advantages of the invention will appear clearly from the following description thereof, given by way of non-limiting illustration, with reference to the annexed drawings, in which.

The invention proposes a watch provided with an electric power supply that supplies first and second voltage levels. The watch has a case that includes a circuit controlling the electric motor via application of these voltage levels to first and second output connections of the case. A switch controlled by an external control actuator selectively connects the first output connection to the second voltage level. The control circuit includes first and second three-state gates connected to the first and second output connections. In test mode, the gates are brought to high impedance and the first output connection is connected to the first voltage level. The output voltage of the first gate is measured to determine whether the external control actuator has been actuated.

Figure 1:
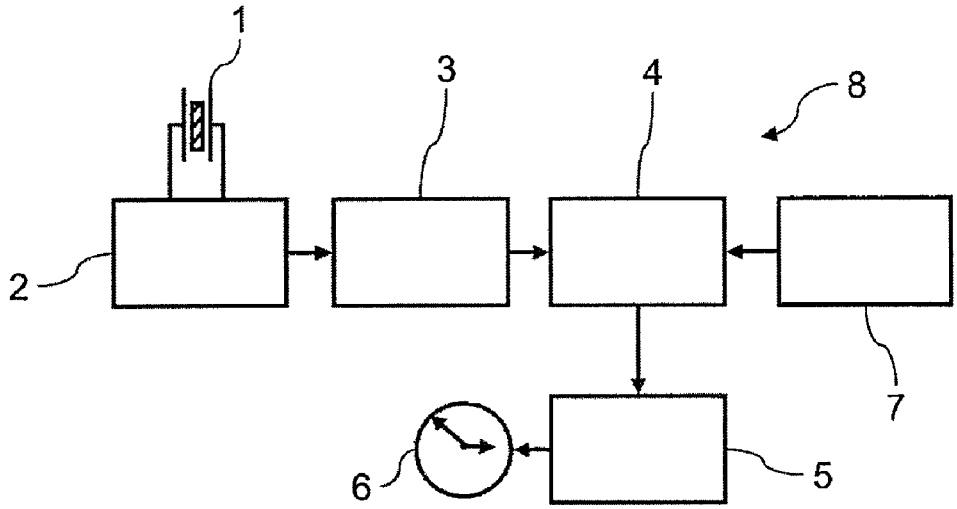
FIG. 1 is a schematic diagram of various components of a watch.

FIG. 1 shows schematically an electronic watch 8. This watch 8 includes analogue display means, in this case a dial 6 fitted with hands. The hands of dial 6 supply a time indication, for example the hours, minutes and possibly seconds. The hands are driven by an electric motor 5, typically a stepping motor. A stepping motor, also called a bipolar motor, is generally formed of a magnetised rotor, a stator with high magnetic permeability, for forming the magnetic circuit loop and at least one coil, which creates a magnetic field in the stator when it is switched on. The stator placed in the magnetic field changes into a magnet whose polarity depends upon the direction of the current in the coil. One could, of course, use other types of motors, such as a two-phase stepping motor, which provides a two-directional motor and thus a watch that can be adjusted forwards and backwards. Watch 8 includes a control circuit 4 that selectively supplies current in the coil of motor 5. Control circuit 4 supplies a series of positive and negative pulses separated by current interruptions or cut offs. During a pulse, first and second distinct voltage levels are simultaneously applied across two terminals of motor 5. These voltage levels, respectively Vss and Vdd, are supplied by a power circuit 7. Conventionally, voltage Vdd is higher than voltage Vss.

A time base allows control circuit 4 to determine the frequency at which motor 5 has to be powered. The time base includes a resonator 1, such as a quartz resonator, or a silicon resonator. An oscillator 2 is connected to the terminals of resonator 1. The signal generated by the resonator/oscillator pair is applied to a frequency divider circuit 3. Frequency divider 3 supplies the various working frequencies necessary to control circuit 4 so that watch 8 indicates the precise time.

Figure 2:
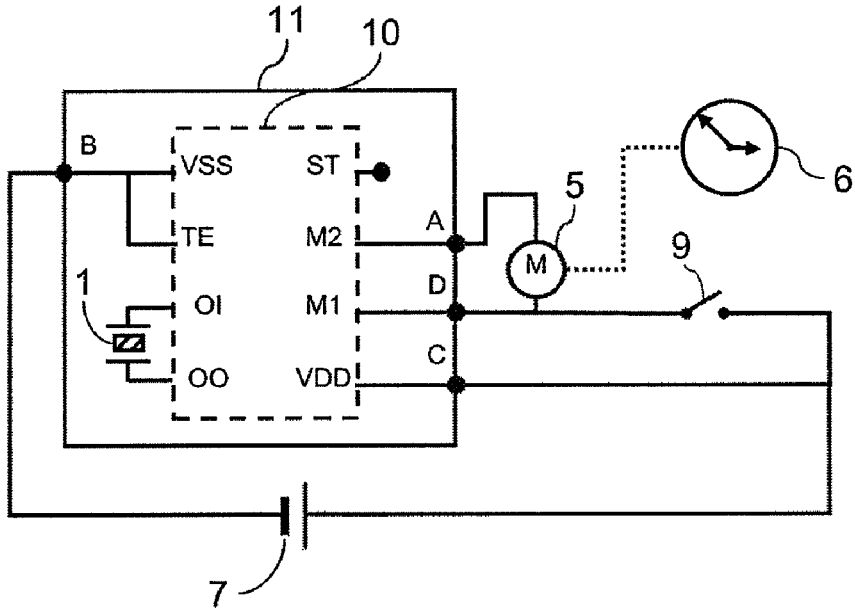
FIG. 2 is a schematic diagram of an electronic case integrated in a watch.

FIG. 2 shows schematically an electronic case 11 integrated in watch 8. Electronic case 11 has input connections B and C, across which power circuit 7 applies respectively voltages Vss and Vdd. Electronic case 11 also has output connections A and D connected to respective supply terminals of motor 5. Voltages Vss and Vdd are selectively applied to output connections A and D. In order to simplify the connections of watch 8, case 11 advantageously only has four electrical connections with the exterior, in this case connections A to D. This reduced number of connections makes it difficult, however, for control circuit 4 to detect an external command to stop motor 5.

Advantageously, oscillator 2, frequency divider circuit 3 and control circuit 4 are integrated in a single integrated circuit 10, included in case 11. The place occupied by the electronic elements of the watch and the electromagnetic interference that these elements experience are greatly reduced. The terminals of integrated circuit 10 are connected to the exterior exclusively via connections A to D. Integrated circuit 10 includes terminals Vss and Te connected to connection B. Circuit 10 includes terminals OI and OO connected to resonator 1. Circuit 10 includes terminals M1 and M2 respectively connected to terminals A and D. Circuit 10 further includes a terminal Vdd connected to connection C.

A switch 9 is connected to connection D and thus to a terminal of motor 5 and also to voltage Vdd supplied by power circuit 7. Switch 9 thus allows voltage Vdd to be selectively applied to connection D when it is closed. Switch 9 is closed by actuating an external control actuator that is not illustrated. This external control actuator is manipulated by the user when he wishes to set the time of watch 8. Closing switch 9 thus interrupts the power supply to motor 5.

Because of the absence of a specific connection of case 11 to determine when switch 9 is closed, the invention proposes a test mode for identifying when the switch is closed without increasing the electric power consumption of circuit 10.

Figure 3:
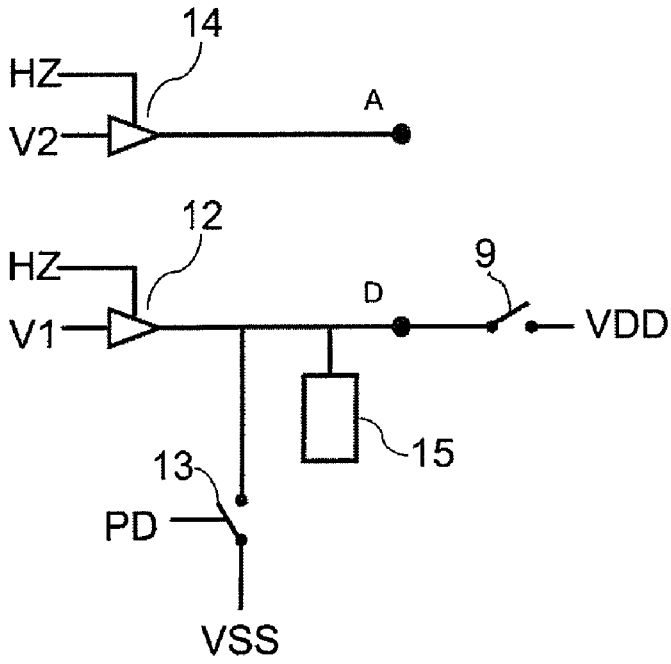
FIG. 3 is a schematic diagram of means for testing whether a regulating switch is closed.

FIG. 3 shows schematically one embodiment of means for testing whether switch 9 is closed, typically included in integrated circuit 10. The control circuit of integrated circuit 10 includes a first three-state gate 12 and a second three-state gate 14. The output of gate 12 is connected to connection D, and the output of gate 14 is connected to connection A. A signal V1 allows to choose between applying voltage Vss and applying voltage Vdd to the output of gate 12. A signal V2 allows to choose between applying voltage Vss and voltage Vdd to the output of gate 14. A signal HZ brings the output of gates 12 and 14 to high impedance, whatever the state of signals V1 and V2. A low level return resistor, which, in the example, is formed by a low level return transistor 13, is connected between connection D and voltage level Vss. This transistor 13 selectively connects the first output connection D to voltage level Vss. A control signal PD can open or close the transistor 13. A module 15 measures the output voltage at gate 12. Module 15 also determines whether switch 9 has been closed in accordance with the voltage measured at the output of gate 12.

Figure 4:
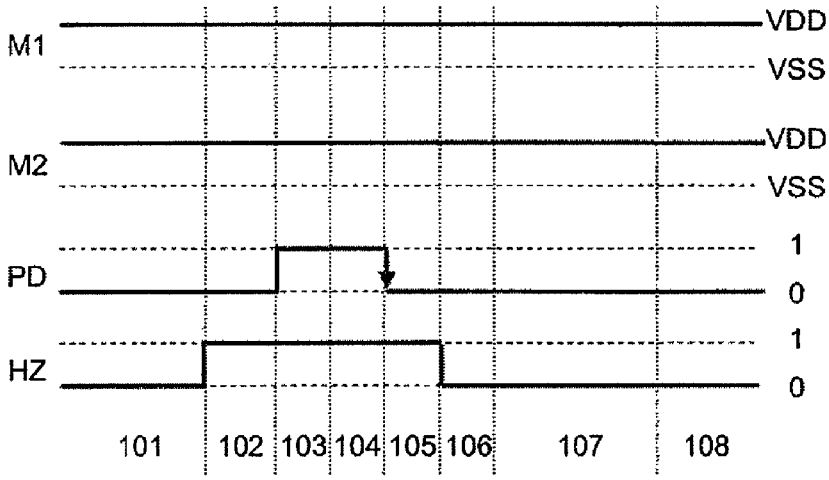
FIG. 4 is a timing diagram showing various signals during closing of the regulating switch.

FIG. 4 is a flow chart illustrating a test phase when switch 9 is closed. At step 101, control circuit 4 stops the motor by applying signals V1 and V2 at a high level to gates 12 and 14. Terminals M1 and M2 are thus kept at the same voltage Vdd. Signal PD commands transistor 13 to open. Signal HZ is at the low state, such that the output of gates 12 and 14 is not at high impedance. During steps 102 to 105, control circuit 4 is in test mode, prior to a phase of driving motor 5.

In step 102, signal HZ passes to the high state, so that the output of gates 12 and 14 is at high impedance. Signal PD is at the low level, switch 13 is therefore open. Since switch 9 is closed, terminals M1 and M2 are at level Vdd.

In step 103, signal PD passes to the high state, which causes transistor 13 to close. As switch 9 is closed, the voltage at terminals M1 and M2 is at level Vdd, since switch 9 has a lower resistance than transistor 13 and since motor 5 is behaving like a resistor.

In step 104, the illustrated signals remain at an identical level to that of step 103. During step 104, the voltage value at terminal M1 is measured by module 15. Module 15 determines that the voltage at terminal M1 has the value Vdd. Module 15 thus determines that switch 19 is closed, and stores this state.

In step 105, signal PD passes to the low level and transistor 13 is thus open. The voltage at terminals M1 and M2 then remains at level Vdd.

In step 106, signal HZ passes to the low level, which is the end of the test mode. The output of gates 12 and 14 is thus no longer at high impedance. Control circuit 4 stops motor 5 by applying signals V1 and V2 at the high level at the inputs of gates 12 and 14. The voltages at terminals M1 and M2 are thus kept at Vdd.

In step 107, as module 15 has determined that switch 9 is closed, motor 5 is prohibited from being driven. The voltages at terminals M1 and M2 are kept at an identical level, namely Vdd.

In step 108, control circuit 4 keeps motor 5 in a stopped state by applying voltage Vdd at terminals M1 and M2.

Figure 5:
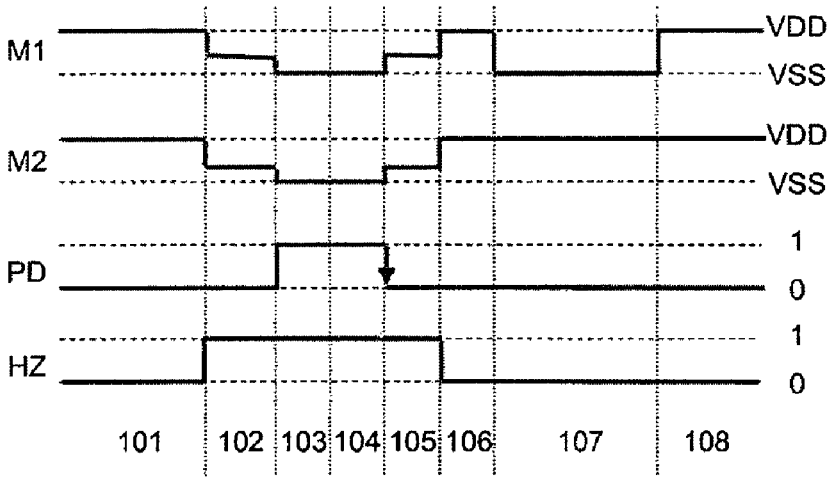
FIG. 5 is a timing diagram showing various signals during opening of the regulating switch.

FIG. 5 is a flow chart illustrating a test phase when switch 9 is open.

In step 101, control circuit 4 stops the motor by keeping terminals M1 and M2 at the same voltage Vdd. Signal PD commands transistor 13 to open. Signal HZ is at the low state, such that the output of gates 12 and 14 is not at high impedance.

In step 102, signal HZ passes to the high state, such that the output of gates 12 and 14 is at high impedance. Signal PD is at the low level and switch 13 is thus open. Terminals M1 and M2 are thus at an intermediate level between Vdd and Vss.

In step 103, signal PD passes to the high state, which causes transistor 13 to close. As switch 9 is open, the voltage at terminals M1 and M2 is returned to level Vss by closed transistor 13.

In step 104, the signals illustrated remain at an identical level to that of step 103. During step 104, the voltage value at terminal M1 is measured by module 15. Module 15 determines that the voltage at terminal M1 is at value Vss. Module 15 thus determines that switch 9 is open, and therefore that the external actuator has not been actuated.

In step 105, signal PD passes to the low level and transistor 13 is thus open. The voltage at terminals M1 and M2 then passes to an intermediate level between levels Vss and Vdd.

In step 106, signal HZ passes to the low level, which is the end of the test mode. The output of gates 12 and 14 is then no longer at high impedance. Control circuit 4 stops the motor by applying signals V1 and V2 at the high level across the inputs of gates 12 and 14. The voltages at terminals M1 and M2 are thus returned to Vdd.

In step 107, as module 15 has determined that switch 9 is open, motor 5 can be driven. The voltages at M1 and M2 are thus at distinct levels, namely Vss and Vdd respectively, for one pulse.

In step 108, control circuit 4 keeps motor 5 in a stopped state by applying voltage Vdd to terminals M1 and M2.

The invention thus determines whether switch 9 is open or closed without relying on an additional electric connection on case 11 and without involving an increase in electric power consumption. A test mode is thus launched prior to each programmed driving of motor 5. Advantageously, control circuit 4 passes into test mode at least twice prior to each motor drive command. Control circuit 4 will only stop motor 5 being driven if it is determined that switch 9 is closed for passages into test mode. Thus, this prevents an erroneous and isolated detection of closure of switch 9 from blocking the driving of motor 5.

What is claimed is:

1. An electronic watch including:

an electric motor driving analogue display means;

an electric power source supplying first and second distinct voltage levels:

a case in which there are mounted:

first and second output connections;

a control circuit for the electric motor controlling the driving of the motor via the selective application of the first and second voltage levels to the first and second output connections;

an external control actuator;

a switch actuated by the external control actuator to selectively connect the first output connection to the second voltage level; wherein:

the electric motor control circuit includes first and second three-state gates, said three-state gates being respectively connected to the first and second output connections, with a member selectively connecting the first output connection to the first voltage level;

the electric motor control circuit includes a test mode wherein the first and second gates are brought to high impedance, the first output connection is connected to the first voltage level by said member, the output voltage at the first gate is measured, actuation of the external control actuator is determined as a function of the measured output voltage.

2. The electronic watch according to claim 1, wherein the first voltage level is lower than the second voltage level.

3. The electronic watch according to claim 2, wherein the member that selectively connects the first output connection to the first voltage level is a low level return transistor.

4. The electronic watch according to claim 1, wherein the case includes a time base including an oscillator and a resonator, first and second input connections that respectively receive the first and second voltage levels from the power circuit, and wherein the oscillator and the control circuit are arranged in a same integrated circuit.

5. The electronic watch according to claim 1, wherein the control circuit stops the electric motor being driven when any actuation of the external control actuator is determined.

6. The electronic watch according to claim 1, wherein the control circuit passes into test mode prior to each motor drive command.

7. The electronic watch according to claim 5, wherein the control circuit passes into test mode at least twice before each motor drive command, the control circuit preventing the electric motor from being driven only when the two passages into test mode have detected actuation of the external control actuator.

8. The electronic watch according to claim 1, wherein the case has only four external electric connections.

9. The Electronic watch according to claim 1, wherein, at the end of the test mode, the control circuit applies the voltages applied prior to the test mode to the output connections.

10. The electronic watch according to claim 1, wherein the electric motor is a stepping motor.

* * * * *